US009793640B1

(12) United States Patent
Choo et al.

(10) Patent No.: US 9,793,640 B1
(45) Date of Patent: Oct. 17, 2017

(54) JOINT CONNECTOR WITH CONTACT RETAINER

(71) Applicants: Hyundai Motor Company, Seoul (KR); Kia Motors Corporation, Seoul (KR); Tyco Electronics AMP Korea Co., Ltd., Gyeongsan, Gyeongsangbuk-Do (KR)

(72) Inventors: Sung Kwan Choo, Gyeonggi-do (KR); Hye Ji Youn, Gyeonggi-do (KR); Kyu Taek Jung, Daegu (KR); Kun Sung Song, Gyeonggi-do (KR)

(73) Assignees: Hyundai Motor Company, Seoul (KR); Kia Motors Corporation, Seoul (KR); Tyco Electronics AMP Korea Co., Ltd., Gyeongsan, Gyeongsangbuk-Do (KR)

( * ) Notice: Subject to any disclaimer, the term of this patent is extended or adjusted under 35 U.S.C. 154(b) by 0 days.

(21) Appl. No.: 15/353,153

(22) Filed: Nov. 16, 2016

(30) Foreign Application Priority Data

Apr. 21, 2016 (KR) ..... 10-2016-0048926

(51) Int. Cl.

| | |
|---|---|
| ***H01R 13/514*** | (2006.01) |
| ***H01R 13/436*** | (2006.01) |
| ***H01R 24/20*** | (2011.01) |
| *H01R 107/00* | (2006.01) |

(52) U.S. Cl.
CPC ..... *H01R 13/4361* (2013.01); *H01R 24/20* (2013.01); *H01R 2107/00* (2013.01)

(58) Field of Classification Search
CPC ..... H01R 13/4361
USPC ..... 439/752
See application file for complete search history.

(56) References Cited

U.S. PATENT DOCUMENTS

| | | | | |
|---|---|---|---|---|
| 5,257,951 | A * | 11/1993 | Maeda | H01R 13/4361 439/752 |
| 5,378,176 | A * | 1/1995 | Sasai | H01R 13/4362 439/752 |
| 5,569,054 | A * | 10/1996 | Yagi | H01R 13/4361 439/595 |
| 6,461,203 | B2 * | 10/2002 | Todo | H01R 13/4362 439/752 |

(Continued)

FOREIGN PATENT DOCUMENTS

| | | |
|---|---|---|
| JP | 05-041070 U | 6/1993 |
| JP | H10172651 A | 6/1998 |

(Continued)

*Primary Examiner* — Neil Abrams
(74) *Attorney, Agent, or Firm* — Mintz Levin Cohn Ferris Glovsky and Popeo, P.C.; Peter F. Corless

(57) ABSTRACT

A joint connector is provided. The joint connector includes a housing, receptacle terminals configured to be inserted into the housing and a retainer configured to be slidably inserted into the housing and displace the receptacle terminals in an insertion direction to fix the position of the receptacle terminals. Accordingly, defects that include an insertion of the terminals during fastening of the retainer to the housing are detected and the receptacle terminals are compressed by the retainer. The shapes of a top surface and a bottom surface of the retainer are formed in an asymmetrical structure to prevent an inverse insertion of the retainer. Simultaneously, a quality problem due to delamination of the retainer is prevented.

10 Claims, 5 Drawing Sheets

(56) References Cited

U.S. PATENT DOCUMENTS

| | | | | |
|---|---|---|---|---|
| 6,494,750 | B2 * | 12/2002 | Morita | H01R 4/184 439/595 |
| 6,497,591 | B2 * | 12/2002 | Fujita | H01R 13/4362 439/752 |
| 6,676,453 | B1 * | 1/2004 | Rosset Rubio | H01R 13/4362 439/752 |

FOREIGN PATENT DOCUMENTS

| | | | |
|---|---|---|---|
| JP | H10-255891 | A | 9/1998 |
| JP | H11-214064 | A | 8/1999 |
| KR | 20-2009-0001522 | U | 2/2009 |
| KR | 2014-0107070 | A | 9/2014 |

* cited by examiner

JOINT CONNECTOR WITH CONTACT RETAINER

CROSS-REFERENCE TO RELATED APPLICATION

This application is based on and claims the benefit of priority to Korean Patent Application No. 10-2016-0048926, filed on Apr. 21, 2016 in the Korean Intellectual Property Office, the disclosure of which is incorporated herein in its entirety by reference.

BACKGROUND

Field of the Disclosure

The present disclosure relates to a joint connector, and more particularly, to a joint connector of a retainer fastening type that fixes the position of the terminals mounted therein.

Description of the Related Art

Typically, a vehicle includes components to electrically connect electric components within the vehicle. The electric component is installed with a cable that forms a plurality of different circuits. The circuit is electrically connected independently to the electric component, however, several circuits may be connected to operate as a single circuit. Accordingly, a joint connector is installed to connect a plurality of circuits as the single circuit. Currently, a vertical fastening type includes a retainer or a fastening type with a hinge has been used as a structure to prevent terminals that are used to connect joints of the circuit (e.g., 'joint connector') from being pushed out. Typically, it is difficult to detect when the retainer is insufficiently fastened. For example, in this structure, when the retainer is insufficiently fastened, malfunction of the electric components due to practical contact failure of the terminal, start failure and off due to controller area network (CAN) communication failure, and the like may occur.

The above information disclosed in this section is merely for enhancement of understanding of the background of the invention and therefore it may contain information that does not form the prior art that is already known in this country to a person of ordinary skill in the art.

SUMMARY

The present disclosure provides a joint connector that fixes a position of terminals and prevents the terminals from being displaced (e.g., pushed out) by preventing contact failure between a joint pattern and the terminals and the insufficient fastening of the retainer may be prevented by using a slide fastening type. According to an exemplary embodiment of the present disclosure, a joint connector may include a housing, receptacle terminals inserted into the housing and a retainer slidably inserted into the housing and configured to displace the receptacle terminals in an insertion direction to fix the position of the receptacle terminals. The housing may include a first guide portion exposing a portion of the receptacle terminals and guides the retainer and the retainer may be configured to slid along the first guide portion and have a coupling component formed to compress the receptacle terminals in the insertion direction.

The coupling component may have a chamfer formed at a portion that abuts (e.g., in surface-contact) with the receptacle terminals. The housing may have a step portion formed on an exterior circumference surface thereof and a bending portion formed in the step portion positioned to face the retainer. The retainer may be bent to correspond to the bending portion. The retainer may include a first flange portion configured to slid on a first surface of the housing, a vertical portion that extends from the first flange portion to be perpendicular thereto and a second flange portion configured to slid on a second surface of the housing from the vertical portion. The first flange portion and the second flange portion may be formed to be asymmetrical to each other. The bending portion may be formed in the first flange portion.

The first guide portion may have a width that decreases from a first side of an insertion component into which the retainer is inserted to a second side of the insertion component. The first guide portion may be formed to be perpendicular to the insertion direction of the receptacle terminals. The housing may have a second guide portion positioned adjacent to the first guide portion and may fix the position of the receptacle terminals and the retainer may have a rib that protrudes in a direction toward the receptacle terminals. The rib may be formed to be inclined toward the coupling component. The coupling component may be formed with a first portion positioned perpendicular to a second portion (e.g., in a shape of '⊢').

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
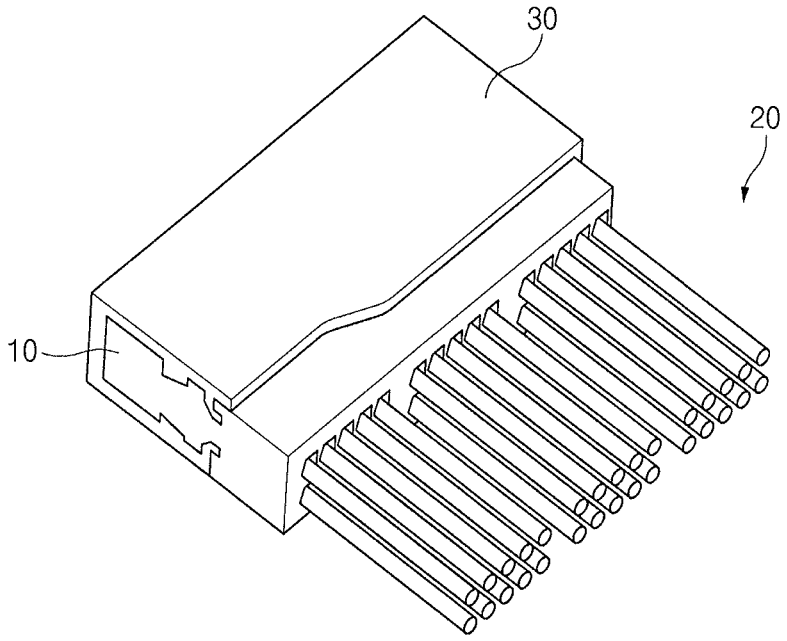
FIG. 1 is an exemplary perspective view illustrating a joint connector according to an exemplary embodiment of the present disclosure.

Advantages and features of the present disclosure and methods to achieve them will be elucidated from exemplary embodiments described below in detail with reference to the accompanying drawings. However, the present disclosure is not limited to exemplary embodiments disclosed below, but will be implemented in various forms. The exemplary embodiments of the present disclosure make disclosure of the present disclosure thorough and are provided so that those skilled in the art can easily understand the scope of the present disclosure. Therefore, the present disclosure will be defined by the scope of the appended claims. Like reference numerals throughout the description denote like elements.

Hereinafter, the present disclosure will be described with reference to the accompanying drawings for describing a joint connector according to exemplary embodiments of the present disclosure. Here, like reference numerals denote like elements in the respective drawings. In addition, a detailed description of functions and/or configurations which are already known will be omitted. The contents disclosed below mainly describe portions necessary to understand operations according to various exemplary embodiments and a description of elements which may obscure the gist of the description will be omitted. In addition, some components shown in the drawings may be exaggerated, omitted or schematically illustrated. The size of each component does not exactly reflect its real size and accordingly, the contents described in this specification are not limited by relative sizes or intervals of the components illustrated in the respective drawings.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 2:
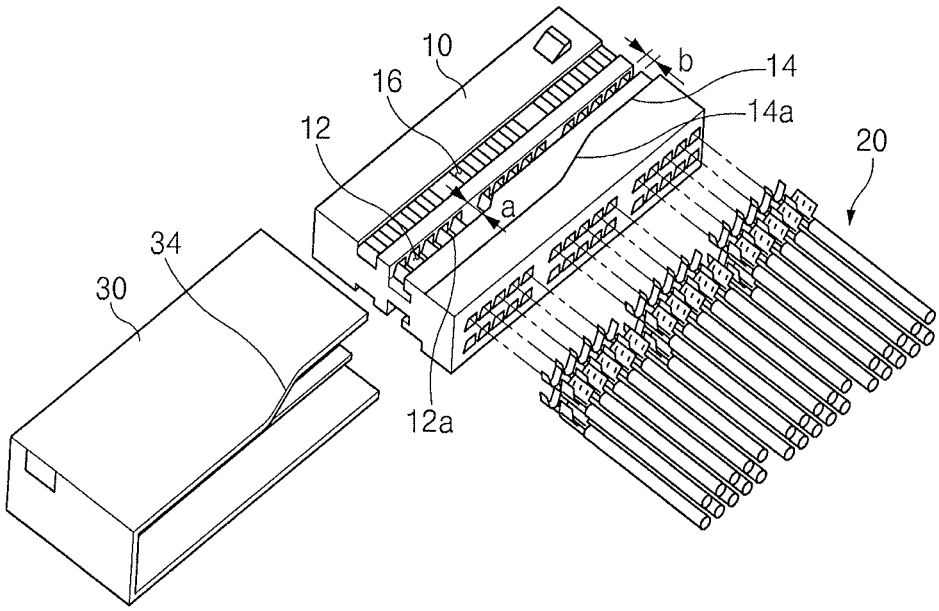
FIG. 2 is an exemplary exploded perspective view of FIG. 1 according to an exemplary embodiment of the present disclosure.
Figure 3B:
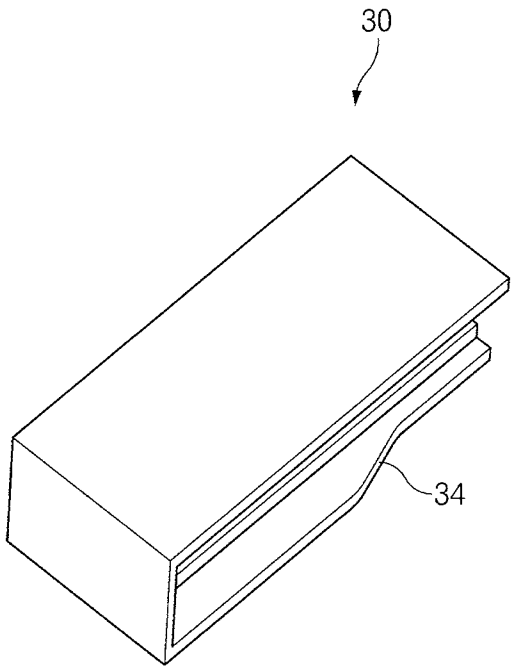
FIGS. 3A and 3B are exemplary perspective views illustrating a retainer of FIG. 2 according to an exemplary embodiment of the present disclosure.
Figure 3A:
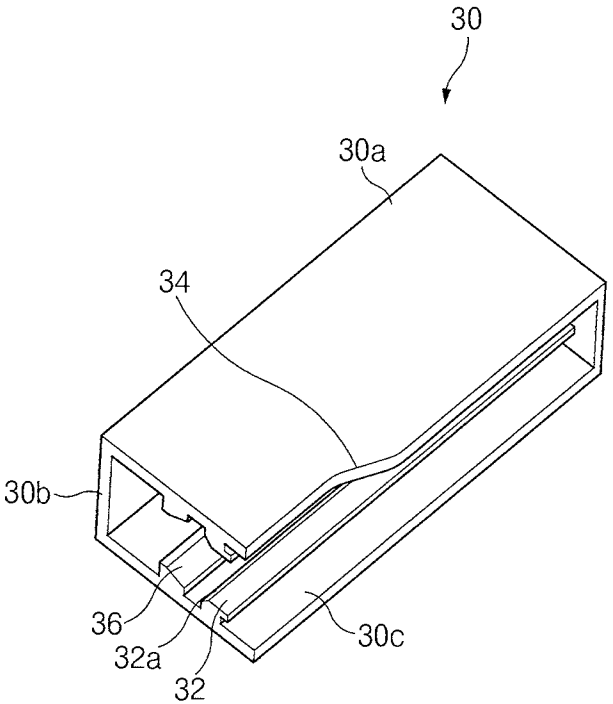
Figures 4A, 4B, 4C:
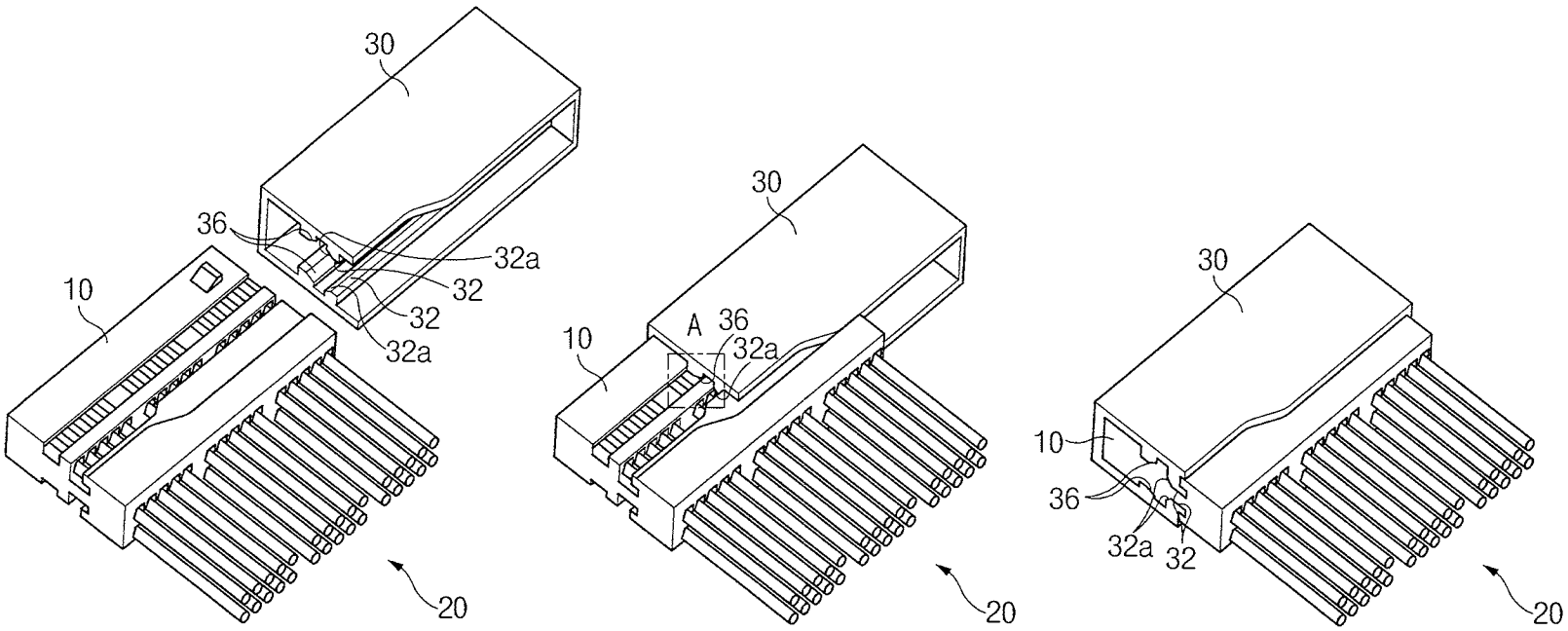
FIG. 4A to 4C are exemplary perspective views illustrating an assembling sequence of the joint connector according to an exemplary embodiment of the present disclosure.
Figure 5:
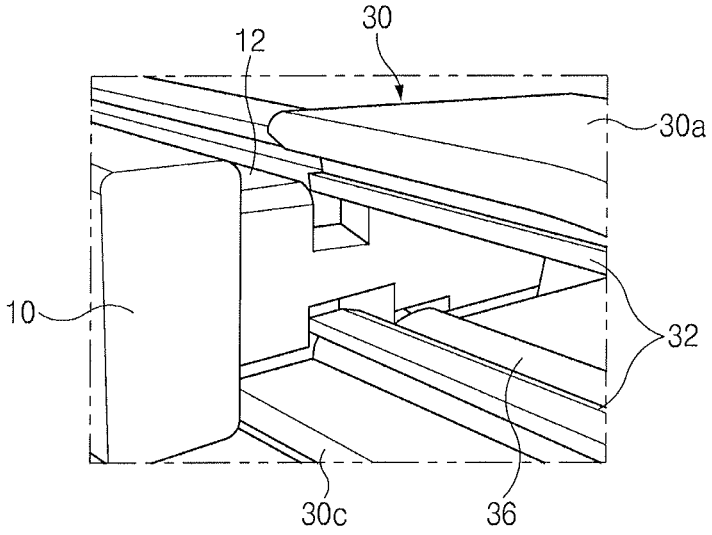
FIG. 5 is an exemplary enlarged view of a part 'A' of FIG. 4B according to an exemplary embodiment of the present disclosure.

FIG. 1 is an exemplary perspective view illustrating a joint connector according to the present disclosure. FIG. 2 is an exemplary exploded perspective view of FIG. 1. FIGS. 3A and 3B are exemplary perspective views illustrating a retainer of FIG. 2. FIG. 4A to 4C are exemplary perspective views illustrating an assembling sequence of the joint connector according to the present disclosure. FIG. 5 is an exemplary enlarged view of a part 'A' of FIG. 4B. A connector for a vehicle may be modified by those skilled in the art, and the present exemplary embodiment corresponds to the case in which the connector for a vehicle is a joint connector.

FIG. 1 is an exemplary perspective view illustrating a joint connector according to the present disclosure and FIG. 2 is an exemplary exploded perspective view of FIG. 1. The joint connector according to the present disclosure will be described with reference to FIGS. 1 and 2. The joint connector may include a housing 10, receptacle terminals 20 configured to be inserted into the housing and a retainer 30 configured to be slidably inserted into the housing 10 and configured to displace (e.g., push) the position of the receptacle terminals 20 in an insertion direction to fix the position of the receptacle terminals 20. The housing 10 may be coupled to the receptacle terminals 20 and the retainer 30. The housing 10 may include an insertion apertures formed therein and the receptacle terminals 20 may be configured to be inserted into the insertion apertures. The housing 10 may include a guide component 12 that to guide the movement of the retainer 30 and may be formed in a groove shape. The guide component 12 may be communication with an interior of the housing 10 and a portion of the receptacle terminals 20 inserted into the housing 10 through the insertion apertures may be exposed to the exterior. The housing 10 may include a first guide portion 12 configured to guide the retainer 30 and a second guide portion 16 formed adjacent to the first guide portion 12 and a portion of the receptacle terminals 20 may be exposed to the exterior through the first guide portion 12 and the second guide portion 16.

Further, the first guide portion 12 may include a width that decreases from a first side of an insertion component into which the retainer 30 may be inserted to a second side of the insertion part to guide the movement of the retainer 30. In other words, the first guide portion 12 may include the width that decreases in a direction in which the retainer 30 is slid. For example, a width (b) of the second side of the insertion component may be less than a width (a) of a first side of the insertion component. The first guide portion 12 may be formed to be perpendicular to an insertion direction of the terminals. The housing 10 may include the second guide portion 16, adjacent to the first guide portion 12 and may be configured to fix the position of the receptacle terminals 20. The first guide portion 12 and the second guide portion 16 may be configured to guide the retainer 30 to be fastened (e.g., coupled) to the housing 10.

The housing 10 may include a step portion 14 formed on an exterior circumference surface thereof. In particular, the step portion 14 may coincide with an exterior circumference surface of the retainer 30. The housing 10 may include a bending portion 14*a* formed in the step portion 14 and the bending portion 14*a* may be positioned to face the retainer 30. In particular, a surface of the retainer 30 that faces the bending portion 14*a* may be bent and coupled to the step portion 14.

The receptacle terminals 20 may have a wire compressed in a terminal and may be inserted into the housing 10. A step formed by compressing the receptacle terminals 20 may be partially exposed to the first guide portion 12 and the second guide portion 16. The retainer 30 may be slidably inserted into the housing 10 to fix the position of the receptacle terminals 20. The retainer 30 may be configured to displace (e.g., push) the receptacle terminals 20 in the insertion direction of the housing 10 and fix the position of the receptacle terminals 20. The retainer 30 may be slid along the first guide portion 12 and the second guide portion 16. The retainer 30 may include a coupling portion 32 formed to compress the portion of the receptacle terminals 20 exposed through the first guide portion 12 in the insertion direction of the housing 10. For example, a chamfer (32*a*) formed on the coupling portion 32 may be configured to compress a portion that abuts (e.g., in a surface-contact) with the receptacle terminals 20. Accordingly, when the receptacle terminals 20 are insufficiently fastened to the housing 10, the retainer 30 may be configured to compress a portion of the receptacle terminals 20 to be coupled to the housing 10.

FIGS. 3A and 3B are exemplary perspective views illustrating a retainer of FIG. 2. For example, referring to FIGS. 3A and 3B, the retainer 30 may include a first flange portion 30*a* configured to slid on a first surface of the housing 10, a vertical portion 30*b* that extends from the first flange portion 30*a* perpendicular thereto and a second flange portion 30*c* configured to slid on a second surface of the housing 10 from the vertical portion 30*b*. The first flange portion 30*a* and the second flange portion 30*c* may be formed to be asymmetrical to each other. The vertical portion 30*b* may be formed with a first portion positioned perpendicular to a second portion (e.g., in a shape of '¬'), and may have two open surfaces of four surfaces of the retainer 30 that allow the housing 10 to be inserted into the opened two surfaces.

The retainer 30 may have a rib 36 that protrudes toward the receptacle terminals 20. The rib 36 may be formed to be inclined toward the coupling portion 32. The coupling portion 32 may be formed in a shape of '∟' to be fixed to the housing 10. Further, the retainer 30 described above may be bent to correspond to the bending portion 14*a* of the housing 10. In other words, the bending portion 34 may be formed in the first flange portion 30*a* to prevent the retainer 30 from being inversely inserted into the housing 10. Accordingly, a mis-assembly of the retainer 30 to the housing 10 may be prevented.

An operation of the joint connector according to an exemplary embodiment of the present disclosure having the configuration as described above will be described. FIG. 4A to 4C are exemplary perspective views illustrating an assembling sequence of the joint connector according to the present disclosure. FIG. 5 is an exemplary enlarged view of a part 'A' of FIG. 4B. The joint connector according to the present disclosure will be described with reference to FIGS. 4A to 4C and 5. The receptacle terminals 20 may be inserted through the insertion apertures of the housing 10. Next, to insert the retainer 30 into the housing 10, the retainer 30 may be inserted into the housing 10 when the coupling portion 32 matches the first guide portion 12, and the rib 36 matches the second guide portion 16.

In particular, the retainer 30 may be displaced (e.g., pushed) to position the second flange portion 30*c* to correspond to the position of the first guide portion and the second guide portion on a lower surface of the housing 10. Additionally, the retainer 30 may be displaced to position the first flange portion 30*a* to correspond to the first guide portion 12 and the second guide portion 16 on an upper surface of the housing 10. To more easily couple the retainer 30 to the housing 10, the retainer 30 may be inserted in a forcedly opened state when initially entering the housing 10.

Due to a wide width of the insertion component and a mold contraction of the retainer, when the retainer is initially fastened to the housing, the retainer may be forcedly opened to be coupled to the housing. In other words, to prevent the retainer and a stopper structure of the housing from being mis-assembled, the stopper structure may be formed to have a width that is greater at an initial entrance section of the housing, and a force stopper structure may be applied when the retainer is stabilized after a predetermined section. In particular, a quality problem due to delamination of the retainer may be prevented. Accordingly, in the joint connector according to the present disclosure, defect such as the insertion of the terminals during fastening the retainer to the housing may be detected. Further, the receptacle terminals may be compressed by the retainer to be inserted therein and shapes of a top surface and a bottom surface of the retainer may be formed in an asymmetrical structure, to prevent an inverse insertion of the retainer. Simultaneously, the delamination of the retainer may be prevented.

In the joint connector according to an exemplary embodiment, the configuration and the method of the above-mentioned exemplary embodiments are not restrictively applied. In other words, all or some of the respective exemplary embodiments may be selectively combined with each other so that they may be variously modified. According to the present disclosure, the joint connector has one or more of the following effects.

First, in the joint connector according to the present disclosure, the failure of the receptacle terminals insufficiently fastened while slidably inserting the retainer into the housing may be detected to reduce the malfunction of the electric component and the failure of the Controller Area Network (CAN) communication.

Second, in the joint connector according to the present disclosure, the receptacle terminals imperfectly fastened to the housing may be displaced into the housing by the retainer to be fastened to the housing and may thereby provide a reduced incident of contact failures.

Third, in the joint connector according to the present disclosure, the top surface and the bottom surface of the retainer may be formed in the asymmetrical structure to prevent the retainer from being inversely inserted into the housing when the retainer initially enters the housing.

Fourth, in the joint connector according to the present disclosure, the mis-assembly due to the mold contraction of the retainer, or the like may be prevented, to reduce delamination of the retainer. However, effects of the present disclosure are not limited to the effects described above, and other effects that are not described above may be clearly understood by those skilled in the art from the claims.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A joint connector, comprising:

a housing;

receptacle terminals configured to be inserted into the housing in a predetermined insertion direction; and a retainer configured to be slidably inserted into the housing and displace the receptacle terminals in the predetermined insertion direction to fix a position of the receptacle terminal, wherein the housing has a first guide portion that exposes a portion of the receptacle terminals and configured to guide the retainer, a step portion formed on an exterior circumference surface thereof, and a bending portion formed in the step portion disposed to face the retainer, and wherein the retainer is configured to slid along the first guide portion, is bent to correspond to the bending portion, and has a coupling component slidably inserted into the first guide portion to compress the portion of the receptacle terminals in the predetermined insertion direction.

2. The joint connector according to claim 1, wherein the coupling component has a chamfer formed an edge thereof to compress the portion of the receptacle terminal in the predetermined insertion direction.

3. The joint connector according to claim 1, wherein the retainer further includes:

a first flange portion is configured to slide on a first surface of the housing;

a vertical portion that extends from the first flange portion to be perpendicular thereto; and a second flange portion is configured to slide on a second surface of the housing from the vertical portion, wherein the first flange portion and the second flange portion are formed asymmetrical to each other.

4. The joint connector according to claim 3, wherein the bending portion is formed in the first flange portion.

5. The joint connector according to claim 1, wherein the first guide portion has a width that decreases from a first side of an insertion component into which the retainer is inserted to a second side of the insertion component.

6. The joint connector according to claim 1, wherein the first guide portion is formed perpendicular to the predetermined insertion direction of the receptacle terminals.

7. The joint connector according to claim 1, wherein the housing has a second guide portion adjacent to the first guide portion and fixes a position of the receptacle terminals, and the retainer has a rib that protrudes in a direction toward the receptacle terminals.

8. The joint connector according to claim 7, wherein the rib is formed to be inclined toward the coupling component.

9. The joint connector according to claim 1, wherein the coupling component is formed with a first portion positioned perpendicular to a second portion to be coupled to the housing.

10. The joint connector according to claim 1, wherein the housing includes insertion apertures formed therein and the receptacle terminals are inserted into the insertion apertures.

* * * * *